United States Patent [19]

Szczesny et al.

[11] Patent Number: 4,653,828

[45] Date of Patent: Mar. 31, 1987

[54] PIN SHROUD WITH UNIVERSAL LATCH MEANS

[75] Inventors: David S. Szczesny, Harrisburg; Gary W. Hawk, Halifax, both of Pa.

[73] Assignee: AMP Incorporated, Harrisburg, Pa.

[21] Appl. No.: 725,833

[22] Filed: Apr. 22, 1985

[51] Int. Cl.[4] ..... H01R 13/627

[52] U.S. Cl. ..... 339/91 R

[58] Field of Search ..... 339/91 R, 17 C

[56] References Cited

U.S. PATENT DOCUMENTS 3,278,714 10/1966 Bernutz ..... 339/91 R
4,415,214 11/1983 Obst ..... 339/91 R
4,433,888 2/1984 Winger ..... 339/91 R

FOREIGN PATENT DOCUMENTS 26703 4/1981 European Pat. Off. ..... 339/91 R

*Primary Examiner*—John McQuade
*Attorney, Agent, or Firm*—F. Brice Faller; Bruce J. Wolstoncroft

[57] ABSTRACT

Pin shroud for reception on pin array upstanding from circuit board has cavity which receives mating connector on pins and latching recesses at different heights from board. A latch member is engaged to appropriate recess determined by height of mating connector.

5 Claims, 6 Drawing Figures

PIN SHROUD WITH UNIVERSAL LATCH MEANS

BACKGROUND OF THE INVENTION

The present invention relates to a shroud for fitting on pins extending through a circuit board from an electrical connector, and particularly to a shroud which can be latched to mating connectors of different heights.

Some board mounted connectors are provided with long pins extending therefrom to facilitate wire wrapping as well as possibly receiving a mating connector on the opposite side of the board. For example, card edge connectors may be mounted to a mother board and have pins extending through plated holes in the board. The pins are retained by interference fit or soldering, and wires are wrapped around the pins on the opposite side of the board. Such connectors are often interconnected by ribbon jumper cables having connectors such as the AMP EUROLATCH connector at both ends. This is facilitated by mounting a shroud on the pins, the shroud having a first face, an opposed second face, and an array of pin receiving passages extending therebetween. The second face opens in a cavity profiled to receive a mating connector therein. Standoffs at opposite ends of the first face permit wire wrap termination.

Mating connectors similar to the EUROLATCH connector, known generically in the industry as the DIN or Eurocard ribbon cable connector, are sold by several manufacturers. These connectors vary in height and accordingly, the respective manufacturers have provided different shroud and latch arrangements. It would be desirable to have a single shroud and latch which could accommodate different height mating connectors.

SUMMARY OF THE INVENTION

According to the invention, a shroud as described above has a plurality of latching recesses at different distances from the plane of the second face and a latching member cooperable with one of said recesses and the mating connector. The recesses are located toward one end of the shroud, providing means for latching one end of the mating connector. A like plurality of recesses, at like different distances from the plane of the second face toward the opposite end of the shroud, provide means for latching the mating connector at the opposite end thereof.

Each latching member has an elongate web with a pair of parallel normally extending latch arms at opposite ends thereof. A pair of latching members is mated to a respective pair of recesses a given distance from the plane of the second face to latch opposite ends of a mating connector to the shroud.

Apertures toward opposite ends of the shroud are profiled to receive respective pins therethrough in an interference fit, whereby the need for mounting hardware is obviated.

DETAILED DESCRIPTION OF THE PREFERRED EMBODIMENT

Figure 1:
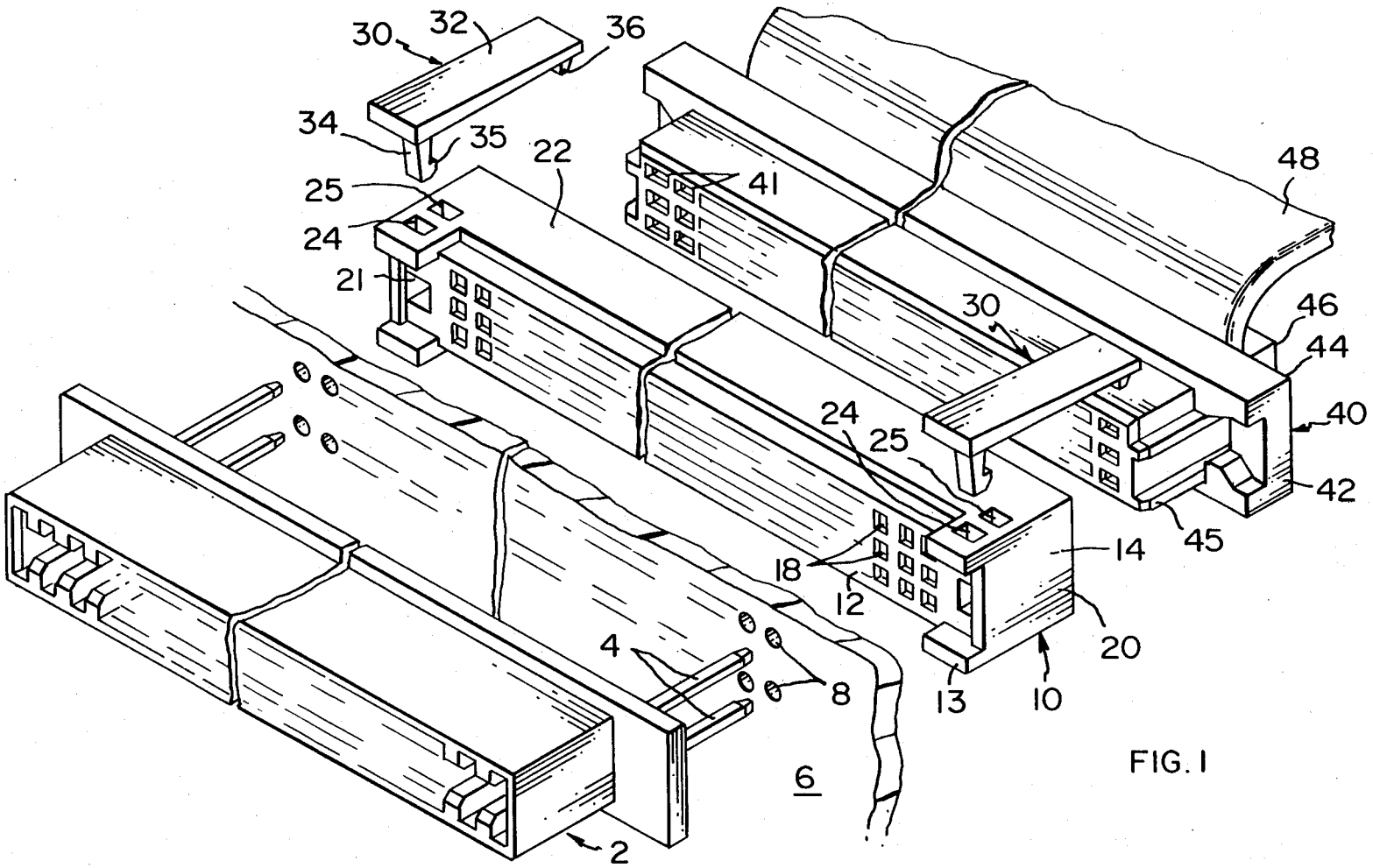
FIG. 1 is an exploded perspective of typical system components.
Figure 2:
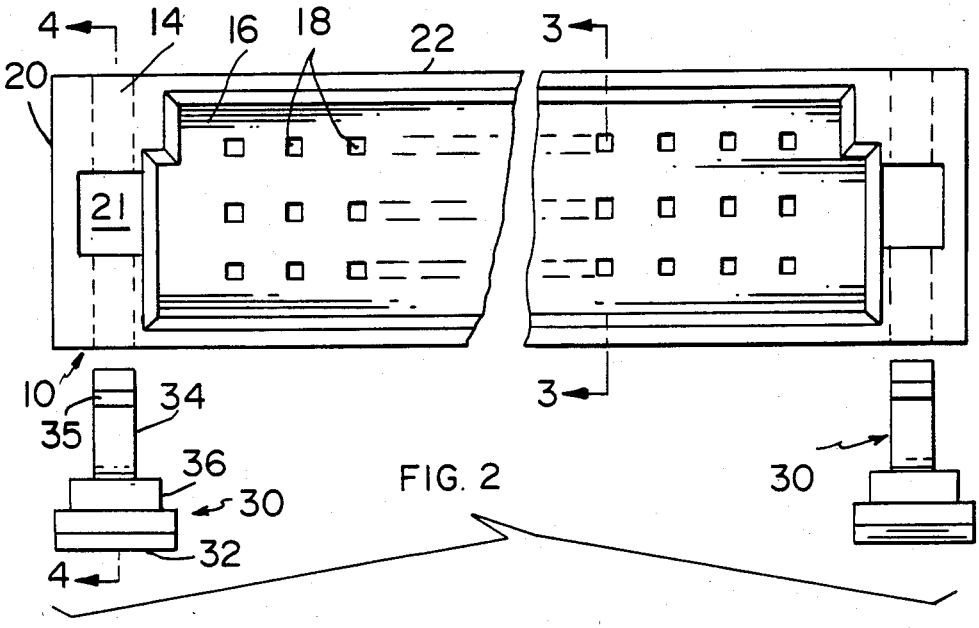
FIG. 2 is a top view of the shroud and latches.

FIG. 1 shows a card edge connector 2 having 0.025 in. square pins extending therefrom for interference fitting in plated through holes 8 in printed circuit board 6. Pin shroud 10 has a first face 12, an opposed second face 14, opposed sidewalls 22, and opposed ends 20. Three rows of passages 18 extend into face 12, the passages 18 in the outermost rows being spaced to receive pins 4. Stand-offs 13 ensure a space between board 6 and face 12. Like numbered recesses 24 or 25, as well as 26 or 27 (FIG. 4), are spaced at like distances from the plane of second face 14, while different numbered recesses 24, 25, 26, 27 are spaced at different distances from face 14. Identical latch members 30 each comprise a web 32 having a first latch arm 34 cooperable with one of recesses 24, 25, 26, 27 and a second latch arm 36 cooperable with a mating connector. The exemplary mating connector 40 comprises a housing 42 having pin receiving apertures 41 spaced as passages 18, and a cover 46 used to terminate ribbon cable 48 to slotted plate terminals protruding above top face 44 of housing 42. Ribs 45 are provided for keying in cavity 16 (FIG. 2). The connector 40 is a rendition of the AMP Eurolatch connector, which typically has two rows of thirty-two contacts each loaded therein for terminating cable having sixty-four conductors on 0.050 in. centerline spacing. The apertures 41 are thus spaced at 0.100 in., an industry standard. However, the dimensions of housing 42 vary between some manufacturers.

FIG. 2 is a top view of pin shroud 10, showing cavity 16 in second face 14. Apertures 18 extend through to opposite face 12 (FIG. 1). While not apparent from the drawings, the apertures 18 toward ends 20 in each row are cored at less than 0.025 in. square to provide an interference fit for respective 0.025 in. square posts 4. Other apertures 18 are cored at greater than 0.025 in. square. Latch members 32 are shown exploded from recesses 24; all recesses 24, 25, 26, 27 open in holes 21, which are conveniently cored with cavity 16 to provide shoulders for engaging the ends of first latch arms 34.

Figure 3:
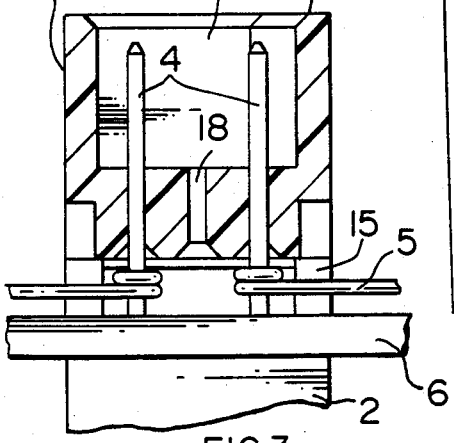
FIG. 3 is a section taken along lines 3—3 of FIG. 2.

FIG. 3 shows the shroud 10 received on posts 4. The shroud 10 is retained against board 6 by the interference fit of pins 4 in some apertures 18 as described above. Stand-offs 15 provide clearance for wire wrap termination of wires 5 to some posts 4 as required in some applications. Wires would, of course, be wrapped prior to forcing the shroud onto posts 4.

Figure 4:
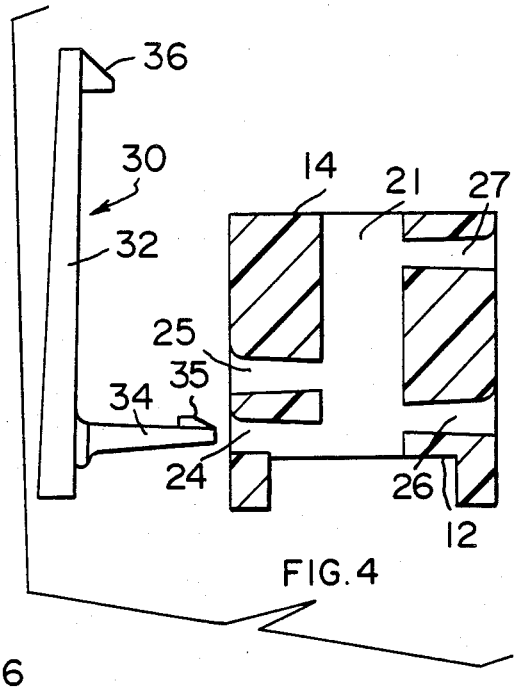
FIG. 4 is a section taken along line 4—4 of FIG. 2.

FIG. 4 is an end section taken along line 4—4 in FIG. 2. Respective recesses 24, 25, 26, 27 at each end are at different distances from second face 14, while like numbered recesses at opposite ends are at a like distance from face 14. The latch 35 on the end of first arm 34 engages the shoulder formed at the intersection of hole 21 and the respective recess in which it is received.

Figure 5A:
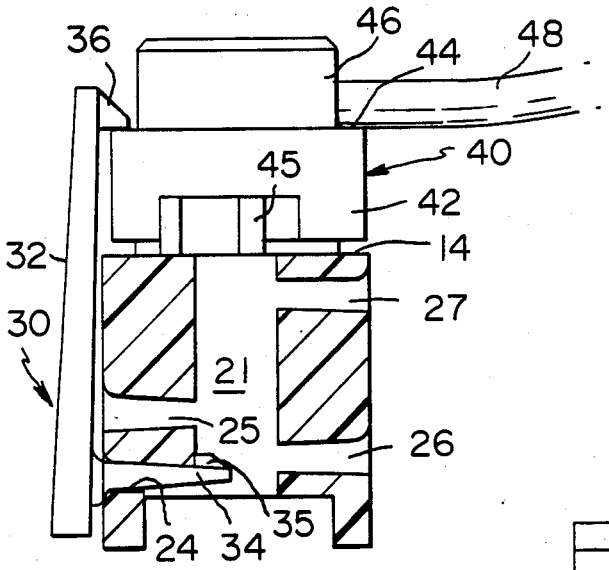
FIG. 5A is a section similar to FIG. 4, with the shroud latched to a short mating connector.
Figure 5B:
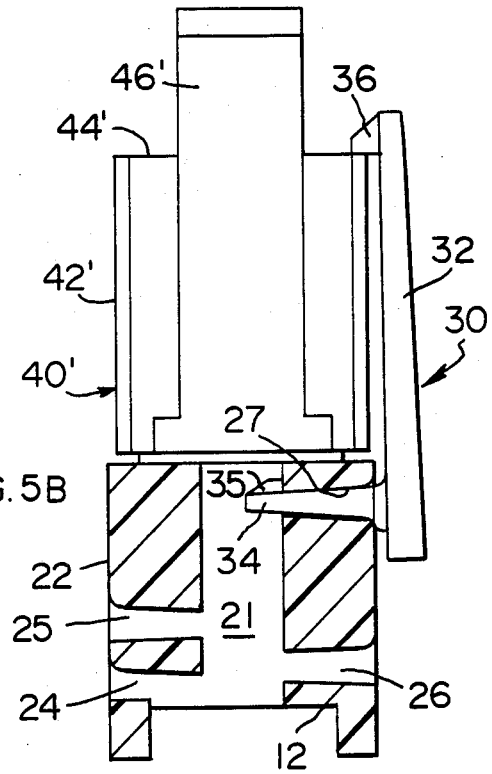
FIG. 5B is a section similar to FIG. 4, with the shroud latched to a tall mating connector.

FIG. 5A depicts connector 40, mated with pins 4 in cavity 16 of shroud 10 (FIG. 3). The first arm 34 is received in recess 24 so that second latch arm 36 snaps onto top surface 44 of housing 42. Since the distance between second surface 14 of shroud 10 and the top surface of the connector housing varies between manufacturers, it will be necessary to engage the latch arm 34 in various of recesses 24, 25, 26, or 27 for such different connectors. FIG. 5B depicts an available connector 40' providing the greatest distance between surface 14 and the top face 44' of the connector. The latch arms 34 at each end are thus inserted in apertures 27 in order to situate latch arms 36 at the correct height for snap engagement on face 44'. The latching member 30 secured in one of latching recesses 24, 25, 26, 27 can be removed by inserting a simple tool in recess 21 and deflecting first arm 34 down. Latching member 30 can thus be placed in another recess 24, 25, 26, 27 to accommodate a mating connector of different height.

The foregoing is exemplary and not intended to limit the scope of the claims which follow.

We claim:

1. A pin shroud assembly comprising:

a pin shroud of the type intended for mounting to a printed circuit board or the like having an array of pins upstanding therefrom, the shroud having a first face, an opposed second face, and a like array of pin receiving passages extending therebetween for receiving the array of pins, the second face opening in a cavity having the pins extending therein such that the cavity is profiled to receive a mating connector therein, the shroud having a plurality of latching apertures positioned between the first face and the second face and spaced at different distances from the plane of the second face; and latching means positioned on the pin shroud by means of a respective latching aperture of the pin shroud, the latching means cooperable with a surface of the mating connector whereby the respective aperture is determined by the height of the mating connector such that as the mating connector is brought into engagement with the pin shroud, the latching means cooperates with the surface of an upper portion of the mating connector and the respective aperture of the shroud, the latching means making latching engagement with the mating connector thereby latching the mating connector to the pin shroud.

2. A pin shroud assembly as in claim 1 wherein said latching apertures are located toward one end of said shroud, said shroud further comprising a like plurality of latching apertures, at like different distances from the plane of said second face toward the opposite end of said shroud, said assembly further comprising a like latching means cooperable with one of said apertures toward said opposite end and said mating connector.

3. A pin shroud assembly as in claim 1 wherein passages toward opposite ends of the shroud are profiled to receive respective pins in an interference fit.

4. A pin shroud assembly as in claim 1 characterized by standoffs at opposite ends of the first face to permit wire wrap termination.

5. A pin shroud assembly as in claim 1 wherein said latching means comprises a web having a pair of parallel normally extending latch arms at opposite ends thereof.

* * * * *